US008884831B2

(12) United States Patent
Amari et al.

(10) Patent No.: US 8,884,831 B2
(45) Date of Patent: Nov. 11, 2014

(54) ANTENNA APPARATUS INCLUDING MULTIPLE ANTENNA PORTIONS ON ONE ANTENNA ELEMENT ASSOCIATED WITH MULTIPLE FEED POINTS

(75) Inventors: Satoru Amari, Osaka (JP); Atsushi Yamamoto, Kyoto (JP); Tsutomu Sakata, Osaka (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 199 days.

(21) Appl. No.: 13/394,940

(22) PCT Filed: Jun. 2, 2011

(86) PCT No.: PCT/JP2011/003114

§ 371 (c)(1),
(2), (4) Date: Mar. 8, 2012

(87) PCT Pub. No.: WO2012/004929

PCT Pub. Date: Jan. 12, 2012

(65) Prior Publication Data

US 2012/0169559 A1 Jul. 5, 2012

(30) Foreign Application Priority Data

Jul. 5, 2010 (JP) ..... 2010-152774

(51) Int. Cl.

| | |
|---|---|
| ***H01Q 13/10*** | (2006.01) |
| ***H01Q 9/04*** | (2006.01) |
| ***H01Q 1/52*** | (2006.01) |
| ***H01Q 21/00*** | (2006.01) |
| ***H01Q 1/24*** | (2006.01) |

(52) U.S. Cl.

CPC ..... *H01Q 1/243* (2013.01); *H01Q 9/0421* (2013.01); *H01Q 1/521* (2013.01); *H01Q 21/00* (2013.01); *H01Q 9/045* (2013.01)

USPC ..... 343/767; 343/700 MS

(58) Field of Classification Search

USPC ..... 343/700 MS, 767, 746

See application file for complete search history.

(56) References Cited

U.S. PATENT DOCUMENTS 3,665,480 A * 5/1972 Fassett ..... 343/754
5,181,044 A 1/1993 Matsumoto et al.

(Continued)

FOREIGN PATENT DOCUMENTS

CN 1357940 A 7/2002
CN 101689703 A 3/2010

(Continued)

OTHER PUBLICATIONS

International Search Report issued Sep. 6, 2011 in International (PCT) Application No. PCT/JP2011/003115.

(Continued)

*Primary Examiner* — Dameon E Levi
*Assistant Examiner* — Harold L Rappaport
(74) *Attorney, Agent, or Firm* — Wenderoth, Lind & Ponack, L.L.P.

(57) ABSTRACT

An antenna apparatus includes: an extension conductor connected to a first section of an outer perimeter of an antenna element and along an entire length of the first section; connecting conductors connecting the antenna element to a ground conductor between the extension conductor and feed points on the antenna element; and a slit extending from the extension conductor to the antenna element so as to intersect a portion between connecting points of the connecting conductors and to intersect a portion between the feed points on the antenna element. The slit has a short-circuited end on the extension conductor.

3 Claims, 19 Drawing Sheets

(56) References Cited

U.S. PATENT DOCUMENTS

| | | | | |
|---|---|---|---|---|
| 5,633,646 | A | 5/1997 | Strickland | |
| 6,633,261 | B2 | 10/2003 | Iwai et al. | |
| 6,744,409 | B2 * | 6/2004 | Ellis et al. | 343/700 MS |
| 6,759,991 | B2 | 7/2004 | Boyle | |
| 6,836,248 | B2 | 12/2004 | Fukushima et al. | |
| 7,352,328 | B2 | 4/2008 | Moon et al. | |
| 7,463,197 | B2 * | 12/2008 | Rafi et al. | 343/700 MS |
| 8,264,414 | B2 | 9/2012 | Sakata et al. | |
| 2002/0075192 | A1 | 6/2002 | Iwai et al. | |
| 2002/0126052 | A1 | 9/2002 | Boyle | |
| 2003/0122718 | A1 * | 7/2003 | Fang et al. | 343/702 |
| 2003/0160728 | A1 | 8/2003 | Fukushima et al. | |
| 2007/0001911 | A1 | 1/2007 | Fujio et al. | |
| 2008/0143612 | A1 | 6/2008 | Iwai et al. | |
| 2009/0153411 | A1 * | 6/2009 | Chiang et al. | 343/702 |
| 2009/0322639 | A1 | 12/2009 | Lai | |
| 2010/0013720 | A1 | 1/2010 | Sakata et al. | |
| 2010/0207823 | A1 | 8/2010 | Sakata et al. | |
| 2011/0199267 | A1 | 8/2011 | Hayashi | |

FOREIGN PATENT DOCUMENTS

| | | |
|---|---|---|
| EP | 1 657 785 | 5/2006 |
| JP | 2-174405 | 7/1990 |
| JP | 2004-32303 | 1/2004 |
| JP | 2004-519914 | 7/2004 |
| JP | 2006-319477 | 11/2006 |
| JP | 2007-97167 | 4/2007 |
| JP | 4437167 | 3/2010 |
| JP | 2010-98683 | 4/2010 |
| WO | 02/075853 | 9/2002 |
| WO | 2005/020371 | 3/2005 |
| WO | 2009/130887 | 10/2009 |

OTHER PUBLICATIONS

International Search Report issued Sep. 6, 2011 in International (PCT) Application No. PCT/JP2011/003114.

International Preliminary Report on Patentability issued Feb. 21, 2013 in International (PCT) Application No. PCT/JP2011/003114.

International Preliminary Report on Patentability issued Feb. 21, 2013 in International (PCT) Application No. PCT/JP2011/003115.

Chinese Office Action and Search Report issued Apr. 15, 2014 in corresponding Chinese Application No. 201180003707.2 (with English translation).

Chinese Office Action and Search Report issued Apr. 22, 2014 in Chinese Application No. 201180003708.7 (with English translation).

U.S. Office Action dated Jan. 30, 2014 issued in U.S. Appl. No. 13/394,660.

USPTO Office Action issued Jun. 20, 2014 in co-pending U.S. Appl. No. 13/394,660.

Extended European Search Report dated Mar. 19, 2014 in European Application No. 11803271.3.

Extended European Search Report dated Mar. 20, 2014 in European Application No. 11803272.1.

Diallo et al., "MIMO performance of enhanced UMTS four-antenna structures for mobile phones in the presence of the user's head", Antennas and Propagation International Symposium, 2007 IEEE, IEEE, Piscataway NJ, USA, Jun. 1, 2007, pp. 2853-2856, XP031169774, ISBN: 978-1-4244-0877-1.

* cited by examiner

ANTENNA APPARATUS INCLUDING MULTIPLE ANTENNA PORTIONS ON ONE ANTENNA ELEMENT ASSOCIATED WITH MULTIPLE FEED POINTS

TECHNICAL FIELD

The present invention mainly relates to an antenna apparatus for use in mobile communication such as mobile phones, and relates to a wireless communication apparatus provided with the antenna apparatus.

BACKGROUND ART

The size and thickness of portable wireless communication apparatuses, such as mobile phones, have been rapidly reduced. In addition, the portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In addition, the portable wireless communication apparatuses are required to handle various applications for voice calls as telephones, data communication for browsing web pages, viewing of television broadcasts, etc. In such circumstances, it is necessary to provide an antenna apparatus operable in a wide frequency range in order to perform wireless communications for the respective applications.

According to the prior art, there were antenna apparatuses covering a wide frequency band and adjusting the resonance frequency, including, for example, an antenna apparatus adjusting the resonance frequency by providing an antenna element portion with a slit as described in Patent Literature 1, and a notch antenna having a trap circuit at a slit as described in Patent Literature 2.

The antenna apparatus of Patent Literature 1 is configured to include: a planar radiating element (radiating plate); a ground plate opposing thereto in parallel; a feed section located nearly at the center of an edge of the radiating plate and supplying a high-frequency signal; a short-circuiting section shorts-circuiting the radiating plate and the ground plate near the feed section; and two resonators formed by providing a slit to an edge of the radiating plate nearly opposing to the feed section. The degree of coupling between the two resonators is optimized by adjusting the shape and dimensions of this slit, or by loading a reactance element or a conductor plate on the slit. Thus, it is possible to obtain a small and low-profile antenna with suitable characteristics.

According to the notch antenna of Patent Literature 2, the slit can be open for radio frequency signals at the position of the trap circuit when the antenna is to resonate in a low-frequency communication band, and the slit can be closed for radio frequency signals at the position of the trap circuit when the antenna is to resonate in a high-frequency communication band. Thus, it is possible to change the resonant length of the notch antenna in an appropriate manner according to a frequency communication band in which the antenna is to resonate.

In addition, an antenna apparatus of Patent Literature 3 is configured to include: a substrate; a plurality of antenna elements located on the substrate and fabricated in a planar shape; and at least one isolation element located on the substrate between the plurality of antenna elements and grounded to a ground portion. The isolation element fabricated between the antenna elements is used to prevent mutual interference between the antenna elements, thus advantageously preventing distortion of a radiation pattern. In addition, the isolation element can operate as a parasitic antenna by connecting the isolation element to a ground plane, thus advantageously increasing the output gain. In addition, the isolation element and the antenna elements can be fabricated by only etching metal films stacked on the substrate in a predetermined configuration. Therefore, the fabrication is facilitated, e.g., a metal film on the substrate forms the isolation element, thus capable of fabricating an antenna apparatus of a planar structure substantially close to two dimensions.

CITATION LIST

Patent Literature

PATENT LITERATURE 1: PCT International Publication No. WO 2002/075853

PATENT LITERATURE 2: Japanese Patent Laid-open Publication No. 2004-32303

PATENT LITERATURE 3: Japanese Patent Laid-open Publication No. 2007-97167

SUMMARY OF INVENTION

In recent years, in order to increase communication capacity to implement high-speed communication, there have appeared antenna apparatuses adopting MIMO (Multi-Input Multi-Output) technology for simultaneously transmitting and/or receiving radio signals of a plurality of channels by spatial division multiplexing. An antenna apparatus performing MIMO communication needs to simultaneously transmit and/or receive a plurality of radio signals having a low correlation with each other, by preventing interference between antenna elements for high isolation therebetween, in order to obtain large communication capacity.

In addition, MIMO communication requires using a wide radio frequency band for, e.g., high-speed communication. For example, a frequency band over 20 MHz or more is used as an operating band for wireless LANs and 3GPP LTE, and a frequency band as wide as 100 MHz is used for IMT-Advanced, i.e., the fourth-generation mobile phones. In addition, although a radio frequency in the 2GHz-band is mainly used for MIMO wireless communication, there is a high possibility of using a 700-MHz band in the U.S. or using an 800-MHz band currently used for mobile phones in Japan. Since the wavelength of the 700-MHz band is as long as about 40 cm, it can be easily seen that the antenna size also increases. Further, a MIMO communication apparatus requires two or more antennas to be provided, and accordingly, if existing antennas are used as they are, then the volume of the antennas is doubled or more increased. However, since mobile phones are desired to be small, the size of MIMO antennas is desired to be further reduced. In addition, as the frequency decreases, the wavelength increases, and the electrical distance between antennas (the distance relative to the wavelength) is shortened, and accordingly, the coupling between the antennas becomes stronger, thus-substantially reducing the power of radio waves to be radiated. Hence, it is strongly desired to provide a small array antenna having high isolation.

According to the prior art for increasing the isolation between antennas disposed close to each other in a low frequency band, there are known techniques such as: increasing the size of antenna elements; increasing the distance between antenna elements; and adding large electromagnetic coupling adjusting means for increasing the isolation. However, all of these techniques increase the size of an antenna apparatus. Since a space in a mobile phone available for embedding an antenna apparatus is decreasing year by year, it is necessary to achieve high isolation in a low frequency band while using a small antenna apparatus.

Although the configurations of Patent Literatures 1 and 2 can change the resonance frequency, they have only one feed portion. Accordingly, there is a problem that these configurations are not available for MIMO communication, communication using a diversity scheme, and adaptive array.

In addition, since the configuration of Patent Literature 3 has a plurality of feed portions, it is available for MIMO communication, communication using a diversity scheme, and adaptive array. However, this configuration has problems that it cannot achieve high isolation at low frequencies, and in addition, a space between antenna elements need to be $\lambda/2$, thus increasing the size of an antenna apparatus.

An object of the present invention is to solve the above-described problems, and to provide an antenna apparatus capable of providing an array antenna having low coupling in a low frequency band, and capable of simultaneously transmitting and/or receiving of a plurality of radio signals having low coupling to each other, while having a simple and small configuration, and to provide a wireless communication apparatus provided with such an antenna apparatus.

According to an antenna apparatus of the first aspect of the present invention, an antenna apparatus is provided with: a planar antenna element provided on a ground conductor; and first and second feed points provided at positions on the antenna element, respectively. The antenna element is simultaneously driven through the first and second feed points so as to simultaneously operate as first and second antenna portions associated with the first and second feed points, respectively. The antenna apparatus is further provided with: a first extension conductor connected to a first section of an outer perimeter of the antenna element and along an entire length of the first section; first and second connecting conductors respectively connecting the antenna element to the ground conductor at first and second connecting points on the antenna element between the first extension conductor and the first and second feed points; and a slit extending from the first extension conductor to the antenna element so as to intersect a portion between the first and second connecting points on the antenna element and to intersect a portion between the first and second feed points on the antenna element, the slit having a short-circuited end on the first extension conductor.

The antenna apparatus is provided with a second extension conductor connected to a second section of the outer perimeter of the antenna element and along an entire length of the second section, the second section being different from the first section. The slit extends from the first extension conductor through the antenna element to the second extension conductor so as to intersect the portion between the first and second connecting points on the antenna element and to intersect the portion between the first and second feed points on the antenna element, and the slit has the short-circuited end on the first extension conductor and has an open end on the second extension conductor.

In the antenna apparatus, the first and second connecting points are provided such that impedances seen from the first and second feed points toward the first and second connecting points are lower than impedances seen from the first and second feed points toward the short-circuited end of the slit on the first extension conductor.

According to an antenna apparatus of the second aspect of the present invention, an antenna apparatus is provided with a planar antenna element provided on a ground conductor; and first and second feed points provided at positions on the antenna element, respectively. The antenna element is simultaneously driven through the first and second feed points so as to simultaneously operate as first and second antenna portions associated with the first and second feed points, respectively. The antenna apparatus is further provided with: a first extension conductor connected to a first section of an outer perimeter of the antenna element and along an entire length of the first section;

first and second connecting conductors respectively connecting the antenna element to the ground conductor at first and second connecting points on the antenna element between the first extension conductor and the first and second feed points; and a slot extending from the first extension conductor to the antenna element so as to intersect a portion between the first and second connecting points on the antenna element and to intersect a portion between the first and second feed points on the antenna element, the slot having a first short-circuited end on the first extension conductor.

The antenna apparatus is further provided with a second extension conductor connected to a second section of the outer perimeter of the antenna element and along an entire length of the second section, the second section being different from the first section. The slot extends from the first extension conductor through the antenna element, to the second extension conductor so as to intersect the portion between the first and second connecting points on the antenna element and to intersect the portion between the first and second feed points on the antenna element, and the slot has the first short-circuited end on the first extension conductor and has a second short-circuited end on the second extension conductor.

In the antenna apparatus, the first and second connecting points are provided such that impedances seen from the first and second feed points toward the first and second connecting points are lower than impedances seen from the first and second feed points toward the first short-circuited end of the slot on the first extension conductor.

According to a wireless communication apparatus of the third aspect of the present invention, the wireless communication apparatus transmits and/or receives a plurality of radio signals, and is provided with the antenna apparatus of the first or second aspect of the present invention.

As described above, according to the antenna apparatus of the present invention, and the wireless communication apparatus using the antenna apparatus, it is possible to achieve MIMO antenna apparatuses capable of resonating the antenna element at a low operating frequency, achieving high isolation between the feed points, and operating with low coupling at a desired operating frequency, while keeping its size small. The resonance frequency of the antenna element is further decreased, in particular, by connecting the extension conductor to the antenna element such that the slit extends to the side of its open end. The slit serves to increase the isolation between the two feed points of the antenna element, and accordingly, it is possible to advantageously decrease not only the resonance frequency of the antenna apparatus, but also the frequency at which the isolation increases. Further, it is possible to decrease only the frequency at which the isolation increases, by connecting the extension conductor to the antenna element such that the slit extends to the side of its short-circuited end. Namely, by using this configuration, it is possible to advantageously adjust the frequency at which high isolation is achieved. The above-described configuration leads to size reduction of the antenna apparatus. The efficiency of each of the plurality of antenna portions is increased by preventing interference between the feed points for high isolation therebetween.

When performing communication using the plurality of feed points at the same time, the antenna element must resonate at a frequency at which the antenna element is to operate, and further, the isolation between the feed points must be high. According to the present invention, it is possible to provide a small wireless communication apparatus capable of resonating the antenna element at a low operating frequency, achieving high isolation between two feed points at an operating frequency, and transmitting and/or receiving MIMO radio signals.

According to the present invention, while using only one antenna elements, it is possible to operate the antenna element as the plurality of antenna portions, and at the same time, achieve isolation between the plurality of antenna portions in a low frequency band. By achieving isolation and thus achieving low coupling between a plurality of antenna portions of a MIMO antenna apparatus, it is possible to simultaneously transmit and/or receive a plurality of radio signals having low coupling to each other, using the respective antenna portions.

DETAILED DESCRIPTION OF THE INVENTION

Figure 1:
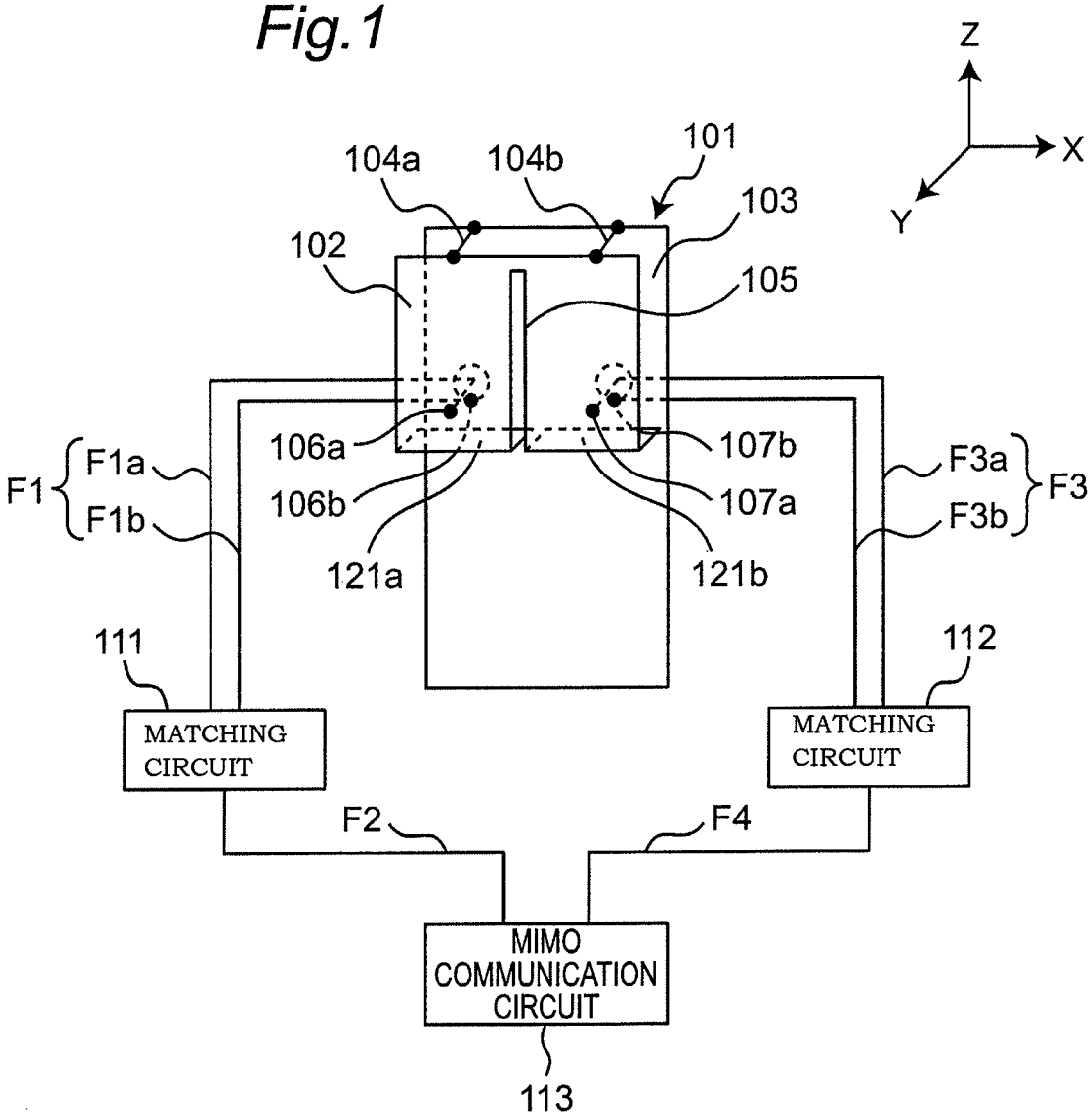
FIG. 1 is a block diagram showing schematic configurations of an antenna apparatus 101 and a wireless communication apparatus using the antenna apparatus 101, according to a first embodiment of the present invention.

Embodiments according to the present invention will be described below with reference to the drawings. Note that like components are denoted by the same reference numerals.

First Embodiment

FIG. 1 is a block diagram showing schematic configurations of an antenna apparatus 101 and a wireless communication apparatus using the antenna apparatus 101, according to a first embodiment of the present invention. The antenna apparatus 101 of the present embodiment includes a rectangular antenna element 102 having two different feed points 106*a* and 107*a*. The single antenna element 102 operates as two antenna portions by driving the antenna element 102 as a first antenna portion through the feed point 106*a*, and at the same time, driving the antenna element 102 as a second antenna portion through the feed point 107*a*.

In general, if providing a single antenna element with a plurality of feed ports (or feed points), it is not possible to achieve isolation between the feed ports, and accordingly, the electromagnetic coupling between different antenna portions increases, thus increasing correlation between signals. Therefore, for example, upon reception, identical received signals are outputted from the respective feed ports. In such a case, good diversity or MIMO characteristics cannot be obtained. According to the present embodiment, a slit 105 is provided between the feed points 106*a* and 107*a* of the antenna element 102, and the length of the slit 105 is used to adjust the resonance frequency of the antenna element 102 and further adjust the frequency at which isolation can be achieved between the feed points 106*a* and 107*a*. Further, according to the present embodiment, the antenna apparatus 101 is characterized in that the antenna apparatus 101 further includes extension conductors 121*a* and 121*a* (hereinafter, collectively referred to using "121") connected to the antenna element 102 in order to increase the resonant length of the antenna apparatus, and the slit 105 is provided so as to extend from the antenna element 102 to the extension conductor 121, and the slit has an open end on the extension conductor 121. The term "slit" means a slit having a short-circuited end and an open end, as shown for example in FIG. 1.

Referring to FIG. 1, the antenna apparatus 101 includes the antenna element 102 made of a rectangular conductive plate, and a ground conductor 103 as a ground plane, made of a rectangular conductive plate. The antenna element 102 and the ground conductor 103 are provided in parallel so as to overlap each other, with a certain distance therebetween. The feed points 106*a* and 107*a* are provided on the antenna element 102, with a certain distance therebetween. Further, there are provided linear connecting conductors 104*a* and 104*b* mechanically and electrically connecting the antenna element 102 to the ground conductor 103, at connecting points on the antenna element 102 which are different from the feed points 106*a* and 107*a*. According to the present embodiment, one side of the antenna element 102 and one side of the ground conductor 103 are arranged close to each other, and the connecting conductors 104*a* and 104*b* are provided at positions connecting these sides. However, the positions of the connecting conductors 104*a* and 104*b* are not limited thereto. The extension conductor 121 (i.e., the extension conductors 121*a* and 121*b*) made of rectangular conductive plates is mechanically and electrically connected to a section of an outer perimeter of the antenna element 102 (in the example of FIG. 1, a side opposite to the side to which the connecting conductors 104*a* and 104*b* are connected) and along the entire length of the section. The slit 105 extending from the antenna element 102 to the extension conductor 121 is provided so as to intersect a portion between the feed points 106*a* and 107*a* on the antenna element 102 (on the extension conductor 121, the slit 105 passes through between the extension conductors 121*a* and 121*b*). The slit 105 has a short-circuited end on the antenna element 102 and has an open end on the extension conductor 121. According to the antenna apparatus 101 of the present embodiment, since the extension conductor 121 is connected to the antenna element 102, the resonant length of the antenna apparatus 101 is increased, and further, the slit 105 is extended to the side of its open end.

The feed points 106*a* and 107*a* are respectively connected with feed lines F1 and F3, which penetrate through the ground conductor 103 from its backside. Each of the feed lines F1 and F3 is, for example, a coaxial cable having a characteristic impedance of 50 Ω. Signal lines F1*a* and F3*a* as inner conductors of the feed lines F1 and F3 are connected to the feed points 106*a* and 107*a*, respectively, and signal lines F1*b* and F3*b* as outer conductors of the feed lines F1 and F3 are connected to the ground conductor 103 at connecting points 106*b* and 107*b*, respectively. The feed point 106*a* and the connecting point 106*b* act as one feed port of the antenna apparatus 101, and the feed point 107*a* and the connecting point 107*b* act as another feed port of the antenna apparatus 101. Further, the feed lines F1 and F3 are connected to impedance matching circuits (hereafter, referred to as "matching circuits") 111 and 112, respectively. The matching circuits 111 and 112 are connected to a MIMO communication circuit 113 through feed lines F2 and F4, respectively. Each of the feed lines F2 and F4 also comprises, for example, a coaxial cable having a characteristic impedance of 50 Ω. The MIMO communication circuit 113 transmits and/or receives radio signals of a plurality of channels according to a MIMO communication scheme (in the present embodiment, two channels) through the antenna element 102.

As shown in FIG. 1, the antenna apparatus 101 is configured as a planar inverted-F antenna apparatus.

Effects brought about by providing the antenna element 102 with the slit 105 are as follows. Since the resonance frequency of the antenna element 102 and the frequency at which isolation can be achieved (hereinafter, referred to as an "isolation frequency") change depending on the length of the slit 105, the length of the slit 105 is determined so as to adjust these frequencies.

Specifically, by providing the slit 105, the resonance frequency of the antenna element 102 itself decreases. Further, the slit 105 operates as a resonator according to the length of the slit 105. Since the slit 105 is electromagnetically coupled to the antenna element 102 itself, the resonance frequency of the antenna element 102 changes according to the resonance condition frequency of the slit 105, compared to the case with no slit 105. By providing the slit 105, it is possible to change the resonance frequency of the antenna element 102, and increase the isolation between the feed ports at a certain frequency. In general, the frequency at which high isolation can be achieved by providing the slit 105 is not identical to the resonance frequency of the antenna element 102. Therefore, according to the present embodiment, the matching circuits 111 and 112 are provided between the feed ports and the MIMO communication circuit 113, in order to shift the operating frequency of the antenna element 102 (i.e., the frequency at which desired signals are transmitted and/or received) from the changed resonance frequency due to the slit 105, to an isolation frequency. As a result of providing the matching circuit 111, the impedance of the antenna element 102 seen from a terminal on the side of the MIMO communication circuit 113 (i.e., a terminal on the side connected to the feed line F2) matches the impedance of the MIMO communication circuit 113 seen from the same terminal (i.e., a characteristic impedance of 50 Ω of the feed line F2). Likewise, as a result of providing the matching circuit 112, the impedance of the antenna element 102 seen from at a terminal on the side of the MIMO communication circuit 113 (i.e., a terminal on the side connected to the feed line F4) matches the impedance of the MIMO communication circuit 113 seen from the same terminal (i.e., a characteristic impedance of 50 Ω of the feed line F4). Providing the matching circuits 111 and 112 affects both the resonance frequency and the isolation frequency, but mainly contributes to changing the resonance frequency.

Effects brought about by connecting the extension conductor 121 to the antenna element 102 are as follows. The resonant length of the antenna apparatus 101 increases by connecting the extension conductor 121 to the antenna element 102. Namely, the operating frequency of the antenna apparatus 101 decreases. This results in reduction of antenna size when designing an antenna apparatus 101 with the same operating frequency. Further, since the length of the slit 105 can be increased, there is another effect of decreasing the isolation frequency. Accordingly, in the case where the antenna size is limited and reduction of antenna size is strongly required, as in the case of small wireless terminals such as mobile phones, the antenna apparatus of the present invention can advantageously decrease both the operating frequency and the isolation frequency while maintaining the maximum outer dimensions.

Figure 2A:
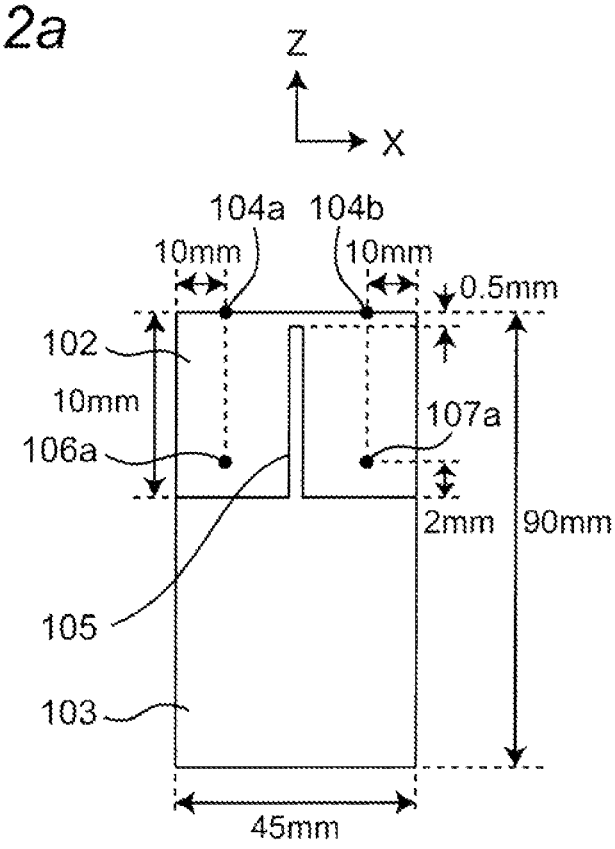
FIG. 2*a* is a front view showing an exemplary implementation of the antenna apparatus 101 of FIG. 1.
Figure 2B:
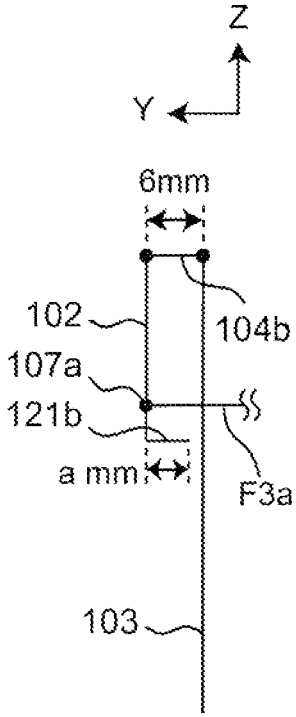
FIG. 2*b* is a side view showing the exemplary implementation of the antenna apparatus 101 of FIG. 1.
Figure 3:
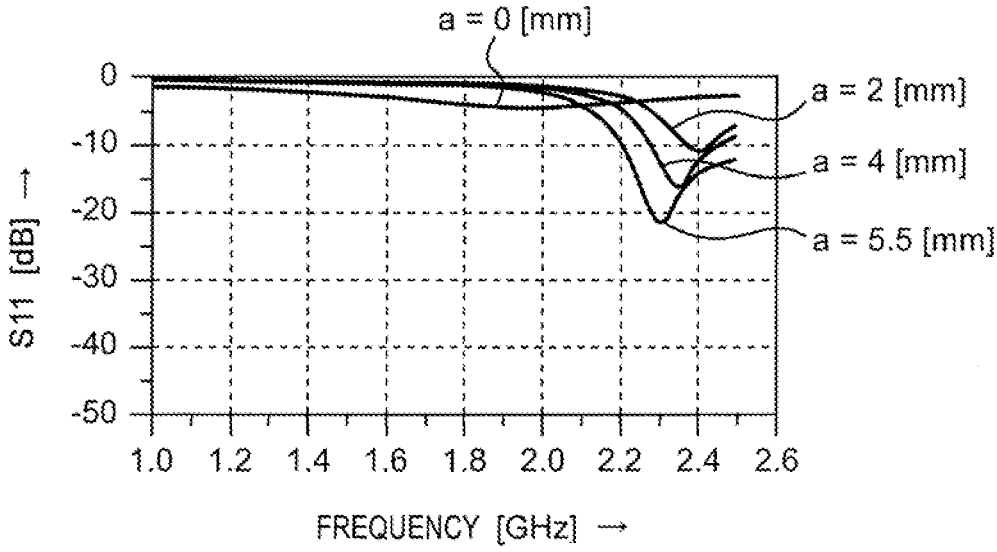
FIG. 3 is a graph showing frequency characteristics of a reflection coefficient parameter S11 for the antenna apparatus 101 of FIGS. 2*a* and 2*b*.
Figure 4:
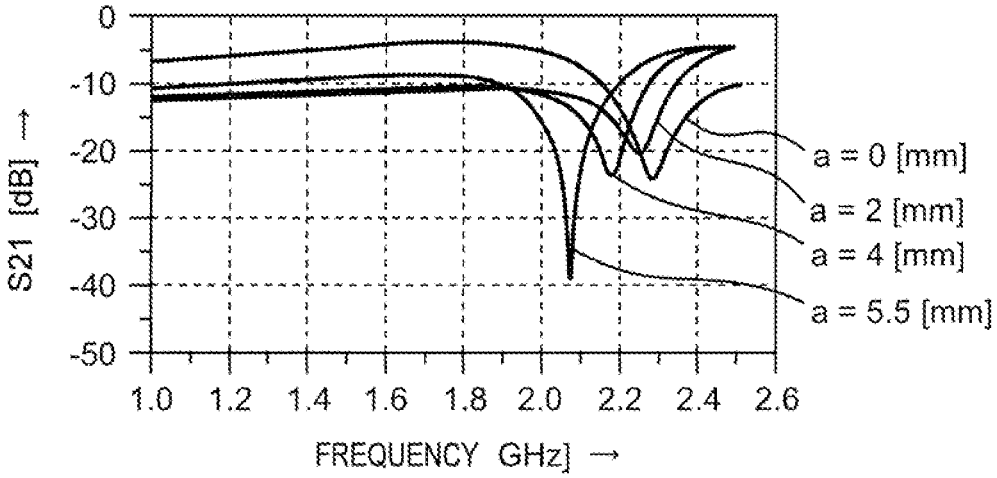
FIG. 4 is a graph showing frequency characteristics of a transmission coefficient parameter S21 for the antenna apparatus 101 of FIGS. 2*a* and 2*b*.
Figure 5:
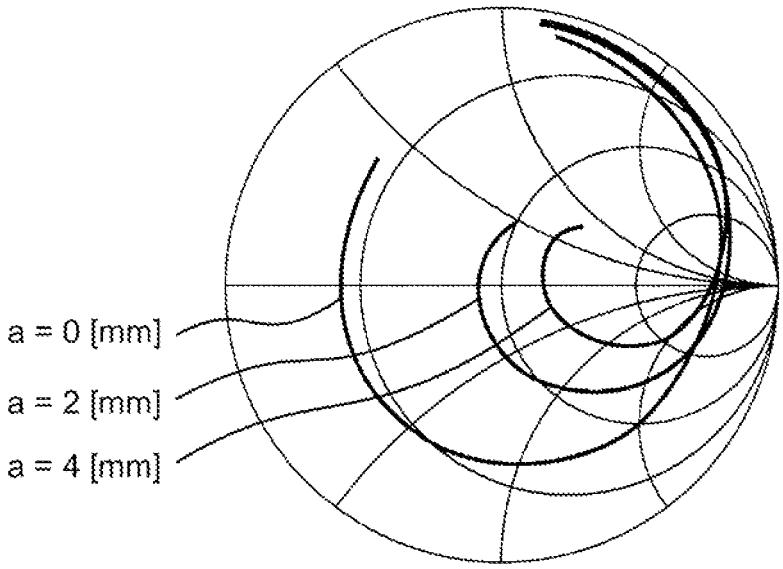
FIG. 5 is a Smith chart for the antenna apparatus 101 of FIGS. 2*a* and 2*b*.

FIG. 2*a* is a front view showing an exemplary implementation of the antenna apparatus 101 of FIG. 1, and FIG. 2*b* is a side view thereof. A slit 105 with a width of 1 mm is provided at the center in a lateral direction of an antenna element 102. The operating characteristics of the antenna apparatus 101 change depending on a length "a" of an extended portion of the slit 105 on the extension conductor 121 (i.e., the length of the extension conductor 121). Therefore, in order to verify the effects of the extension conductor 121, the resonance frequency and isolation frequency were examined when changing the length "a" of the extended portion. FIG. 3 is a graph showing the frequency characteristics of a reflection coefficient parameter S11 for the antenna apparatus 101 of FIGS. 2*a* and 2*b*, and FIG. 4 is a graph showing the frequency characteristics of a transmission coefficient parameter S21 for the antenna apparatus 101 of FIGS. 2*a* and 2*b*. FIG. 5 is a Smith chart for the antenna apparatus 101 of FIGS. 2*a* and 2*b*. The length "a" of the extended portion was changed to 0, 2, and 4 mm. According to FIGS. 3 to 5, it is observed that as the length "a" of the extended portion increases, the resonance frequency (the minimal point of S11) and the isolation frequency (the minimal point of S21) shift to lower frequencies. In this case, a frequency change by 100 MHz to 200 MHz was achieved.

The shapes of the antenna element 102 and the ground conductor 103 are not limited rectangular, and may be of any shape according to desired radiation characteristics and the housing of a wireless communication apparatus. In addition, the antenna element 102 may be supported on the ground conductor 103 by a dielectric. The antenna element 102 and the ground conductor 103 are not limited to being connected by two connecting conductors 104*a* and 104*b*, and may be connected by at least one connecting conductor. In addition, instead of connecting the antenna element 102 to the ground conductor 103 by the plurality of connecting conductors 104*a* and 104*b*, the antenna element 102 and the ground conductor 103 may be connected to each other by a single conductive plate.

Figure 6:
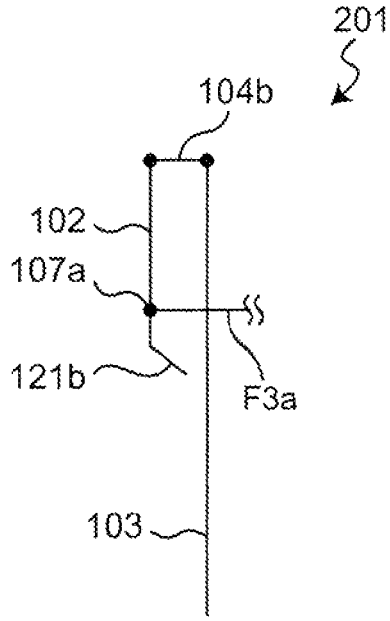
FIG. 6 is a side view showing an antenna apparatus 201 according to a first modified embodiment of the first embodiment of the present invention.
Figure 7:
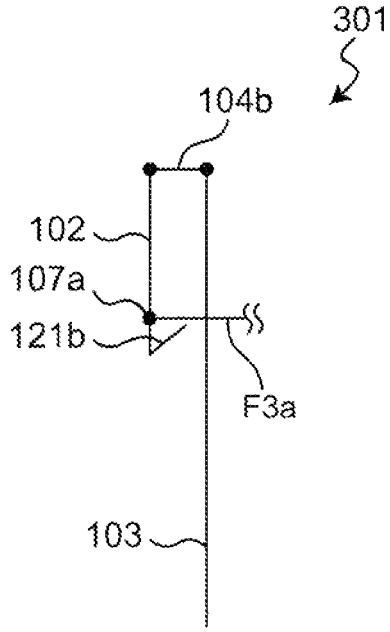
FIG. 7 is a side view showing an antenna apparatus 301 according to a second modified embodiment of the first embodiment of the present invention.
Figure 8:
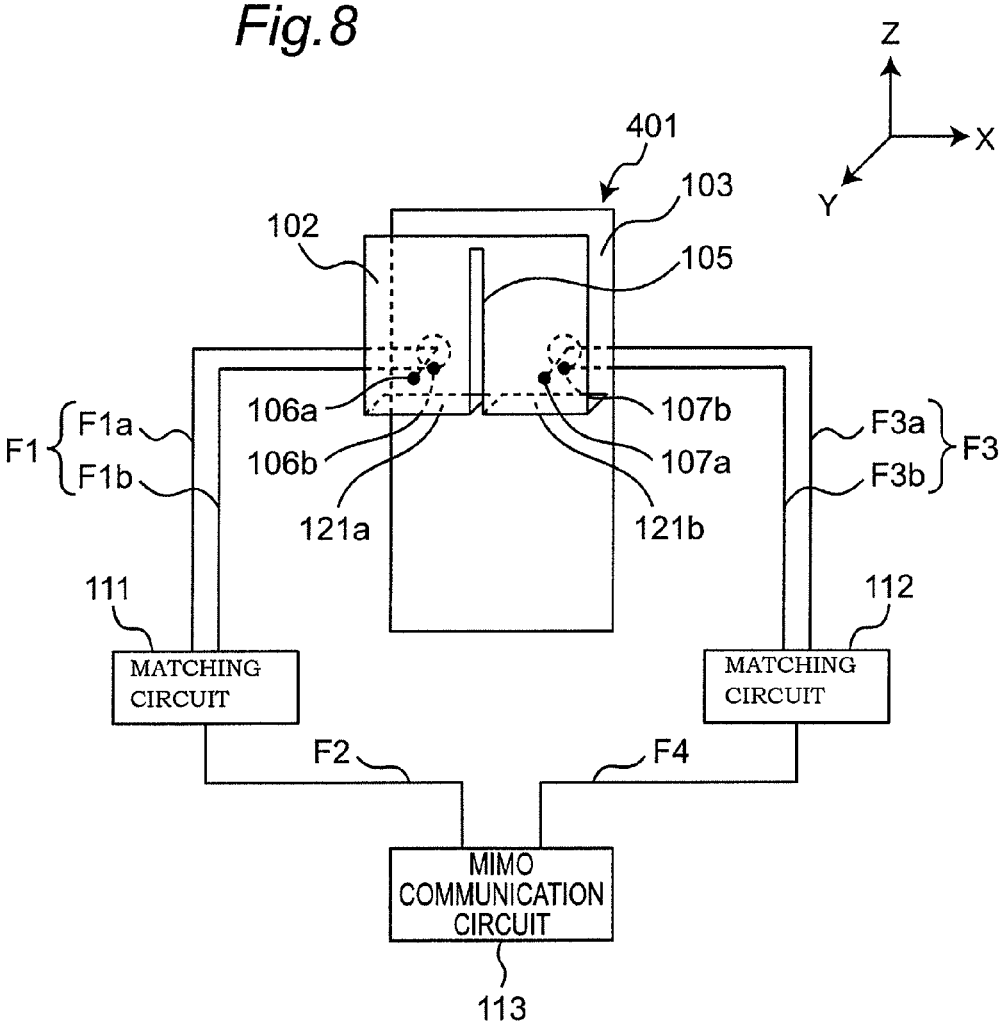
FIG. 8 is a block diagram showing schematic configurations of an antenna apparatus 401 and a wireless communication apparatus using the antenna apparatus 401, according to a third modified embodiment of the first embodiment of the present invention.

FIGS. 6 and 7 are side views showing antenna apparatuses 201 and 301 according to first and second modified embodiments of the first embodiment of the present invention. The extension conductor 121 is preferably bent in a direction from the antenna element 102 to the ground conductor 103 in order not to increase the dimensions of the antenna apparatus. The direction of bending is not limited to a direction perpendicular to the antenna element 102 as shown in FIG. 2*b*, and may be directions such as those shown in FIGS. 6 and 7. FIG. 8 is a block diagram showing schematic configurations of an antenna apparatus 401 and a wireless communication apparatus using the antenna apparatus 401, according to a third modified embodiment of the first embodiment of the present invention. An antenna apparatus of the present embodiment is not limited to an inverted-F antenna apparatus, and may be configured as a planar inverted-L antenna apparatus having no connecting conductors 104*a* and 104*b*.

As described above, the antenna apparatus of the first embodiment is provided with the extension conductor 121 connected to the antenna element 102, and the slit 105 extending from the antenna element 102 to the extension conductor 121, thus decreasing the operating frequency and isolation frequency of the antenna apparatus, and further reducing antenna size.

Second Embodiment

Figure 9:
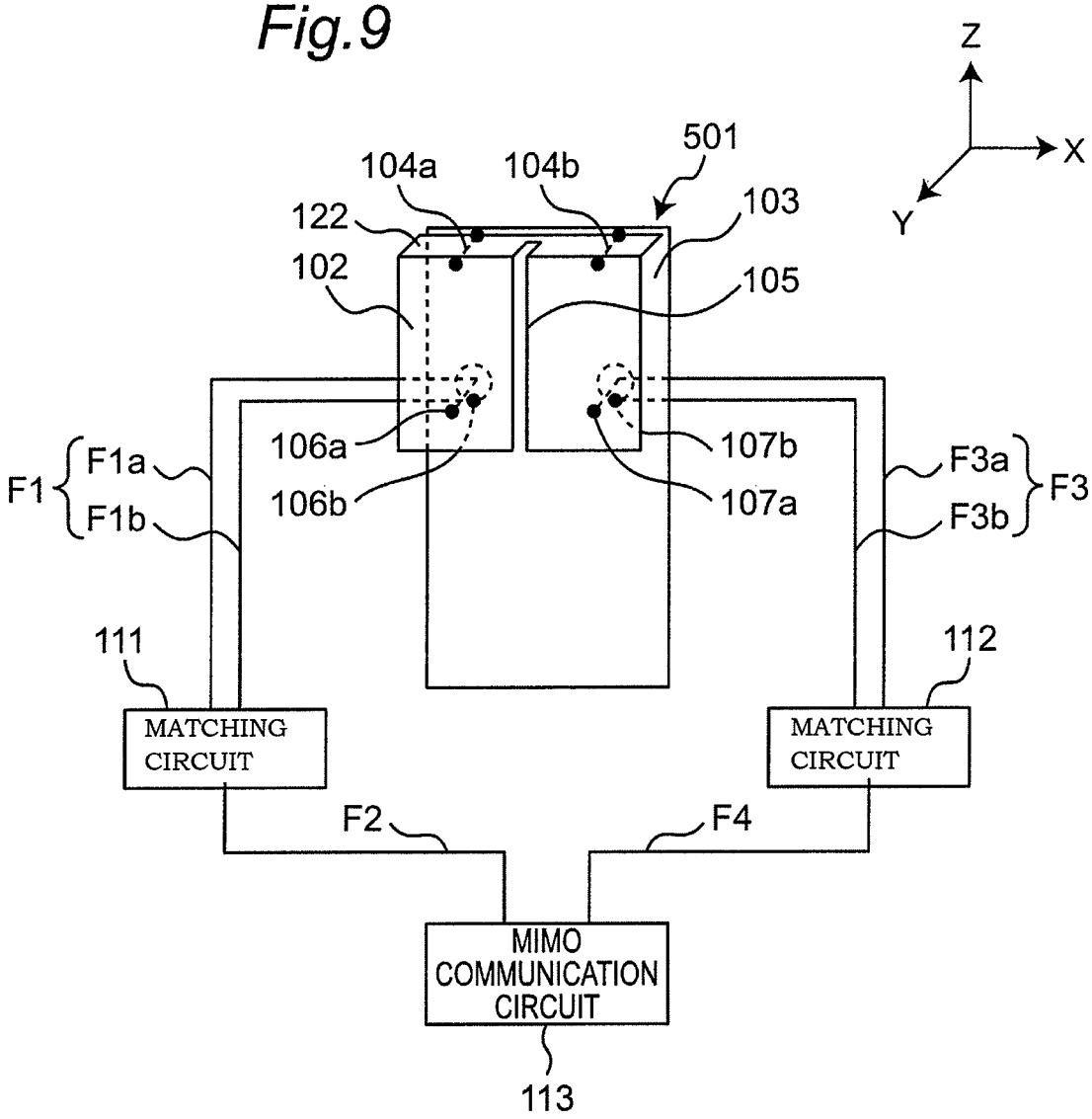
FIG. 9 is a block diagram showing schematic configurations of an antenna apparatus 501 and a wireless communication apparatus using the antenna apparatus 501, according to a second embodiment of the present invention.

FIG. 9 is a block diagram showing schematic configurations of an antenna apparatus 501 and a wireless communication apparatus using the antenna apparatus 501, according to a second embodiment of the present invention. According to the first embodiment, a slit 105 is extended to the side of its open end by connecting extension conductor 121 to an antenna element 102. On the other hand, according to the second embodiment, a slit is extended to the side of its short-circuited end by connecting an extension conductor 122 to an antenna element 102.

Referring to FIG. 9, the antenna apparatus 501 includes the antenna element 102, a ground conductor 103, and feed points 106*a* and 107*a* which are the same as those of the first embodiment. The extension conductor 122 made of a rectangular conductive plate is mechanically and electrically connected to a section of an outer perimeter of the antenna element 102 (an upper side in FIG. 9) and along the entire length of the section. Further, there are provided linear connecting conductors 104*a* and 104*b* which mechanically and electrically connect the antenna element 102 to the ground conductor 103, at connecting points on the antenna element 102 between the extension conductor 122 and the feed points 106*a* and 107*a*. A slit 105 extending from the extension conductor 122 to the antenna element 102 is provided so as to intersect a portion between the connecting points of the respective connecting conductors 104*a* and 104*b* on the antenna element 102 and to intersect a portion between the feed points 106*a* and 107*a* on the antenna element 102. The slit 105 has a short-circuited end on the extension conductor 122 and has an open end on the antenna element 102. According to the antenna apparatus 501 of the present embodiment, since the extension conductor 122 is connected to the antenna element 102, the slit 105 is extended to the side of its short-circuited end.

Figure 11:
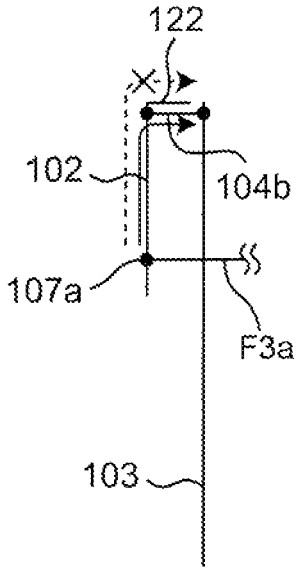
FIG. 11 is a diagram showing a current path on the antenna apparatus 501 of FIG. 9.

Effects brought about by connecting the extension conductor 122 to the antenna element 102 are as follows. FIG. 11 is a diagram showing a current path on the antenna apparatus 501 of FIG. 9. By providing the connecting conductors 104*a* and 104*b* and the slit 105 as shown in FIG. 9, the impedance seen from the feed points 106*a* and 107*a* toward the connecting conductors 104*a* and 104*b* is lower than the impedance seen from the feed points 106*a* and 107*a* toward the short-circuited end of the slit 105. Accordingly, a current on the antenna element 102 flows not toward the short-circuited end of the slit 105, but toward the ground conductor 103 through the connecting conductors 104*a* and 104*b*. Hence, the input impedance and resonant length of the antenna apparatus 501 do not significantly change as a result of providing the extension conductor 122, and thus, the design of the resonance frequency is not significantly affected. On the other hand, the slit 105 extends to the extension conductor 122, and an extended portion of the slit 105 on the extension conductor 122 contributes to decreasing the isolation frequency. In other words, only the isolation frequency can be changed by connecting the extension conductor 122 to the antenna element 102, and the isolation frequency can be finely adjusted by adjusting the length of the extended portion of the slit 105 on the extension conductor 122.

Figure 10A:
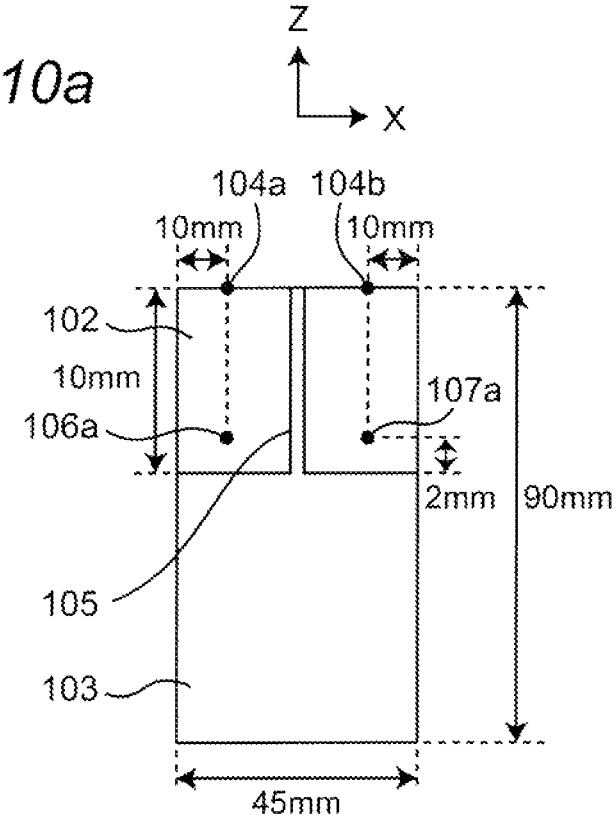
FIG. 10*a* is a front view showing an exemplary implementation of the antenna apparatus 501 of FIG. 9.
Figure 10B:
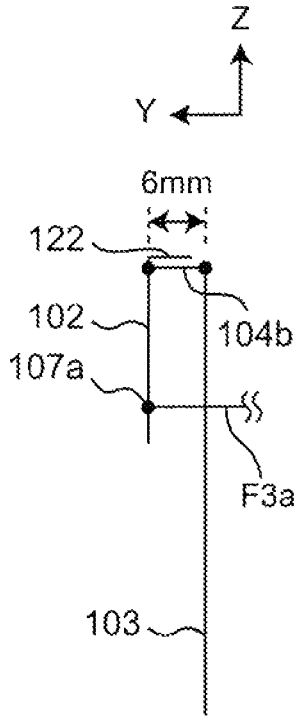
FIG. 10*b* is a side view showing the exemplary implementation of the antenna apparatus 501 of FIG. 9.
Figure 10C:
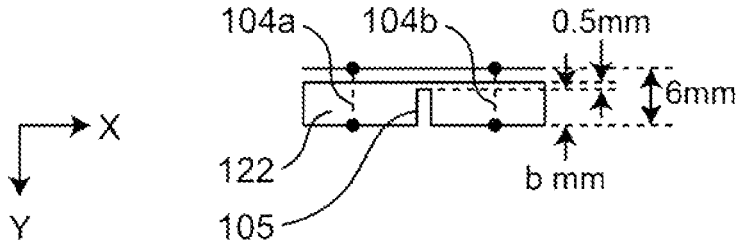
FIG. 10*c* is a top view showing the exemplary implementation of the antenna apparatus 501 of FIG. 9.
Figure 12:
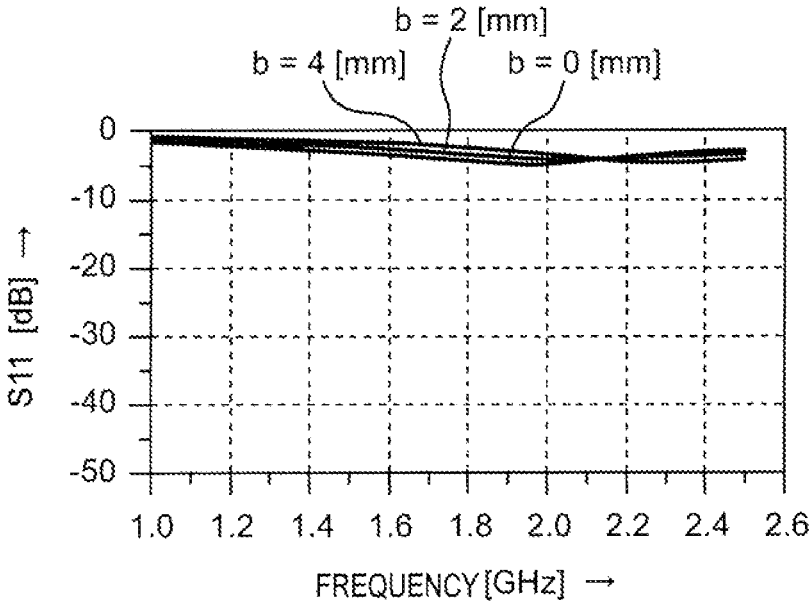
FIG. 12 is a graph showing the frequency characteristics of a reflection coefficient parameter S11 for the antenna apparatus 501 of FIGS. 10*a* to 10*c*.
Figure 13:
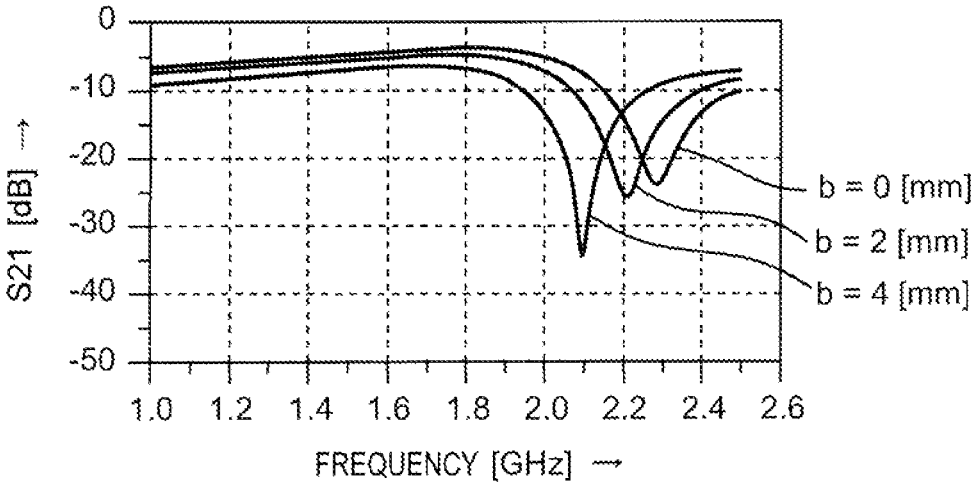
FIG. 13 is a. graph showing the frequency characteristics of a transmission coefficient parameter S21 for the antenna apparatus 501 of FIGS. 10*a* to 10*c*.
Figure 14:
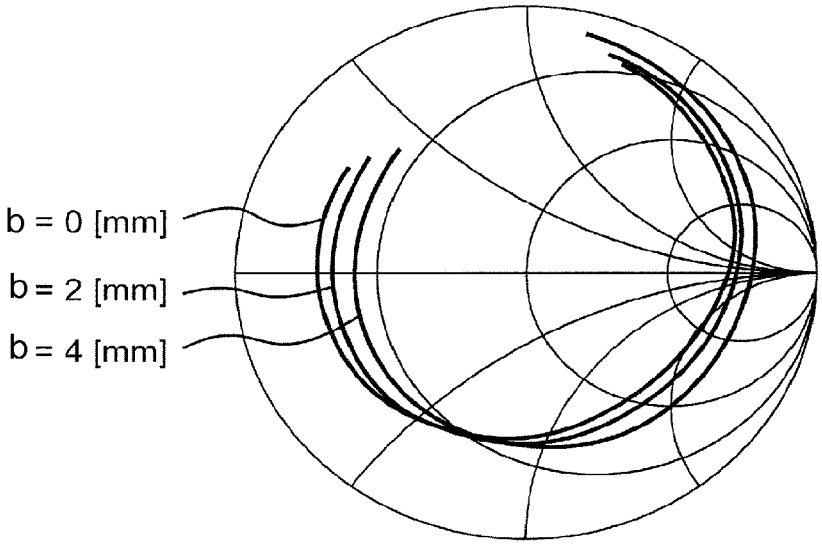
FIG. 14 is a Smith chart for the antenna apparatus 501 of FIGS. 10*a* to 10*c*.

FIG. 10*a* is a front view showing an exemplary implementation of the antenna apparatus 501 of FIG. 9, FIG. 10*b* is a side view thereof, and FIG. 10*c* is a top view thereof. A slit 105 with a width of 1 mm is provided at the center in a lateral direction of an antenna element 102. The operating characteristics of the antenna apparatus 501 change depending on a length "b" of an extended portion of the slit 105 on an extension conductor 122. Therefore, in order to verify the effects of the extension conductor 122, the resonance frequency and isolation frequency were examined when changing the length "b" of the extended portion. FIG. 12 is a graph showing the frequency characteristics of a reflection coefficient parameter S11 for the antenna apparatus 501 of FIGS. 10*a* to 10*c*, and FIG. 13 is a graph showing the frequency characteristics of a transmission coefficient parameter S21 for the antenna apparatus 501 of FIGS. 10*a* to 10*c*. The length "b" of the extended portion was changed to 0, 2, and 4 mm. According to FIGS. 12 to 13, it is observed that as the length "b" of the extended portion increases, though the resonance frequency (S11) does not change almost at all, the isolation frequency (the minimal point of S21) shifts to lower frequencies. In this case, a frequency change by 100 MHz to 200 MHz was achieved. FIG. 14 is a Smith chart for the antenna apparatus 501 of FIGS. 10*a* to 10*c*. According to FIG. 14, it can be seen that even if the length "b" of the extended portion is changed, the impedance does not substantially change.

Figure 15:
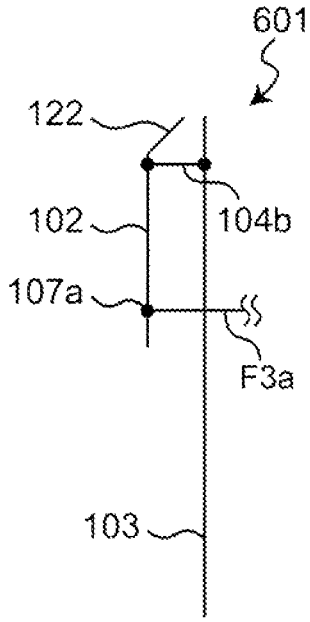
FIG. 15 is a side view showing an antenna apparatus 601 according to a first modified embodiment of the second embodiment of the present invention.
Figure 16:
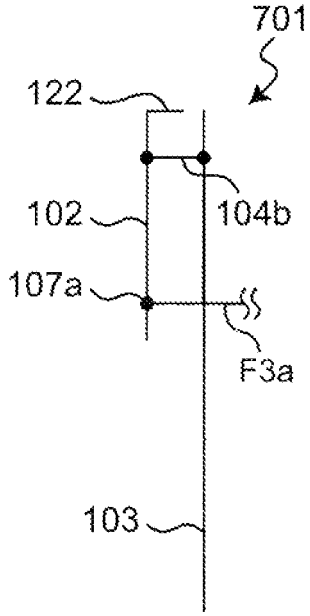
FIG. 16 is a side view showing an antenna apparatus 701 according to a second modified embodiment of the second embodiment of the present invention.
Figure 17:
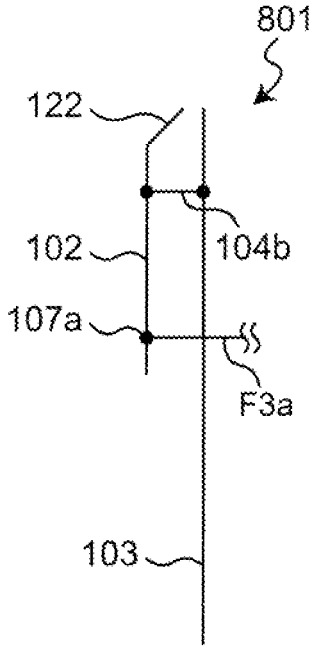
FIG. 17 is a side view showing an antenna apparatus 801 according to a third modified embodiment of the second embodiment of the present invention.
Figure 18:
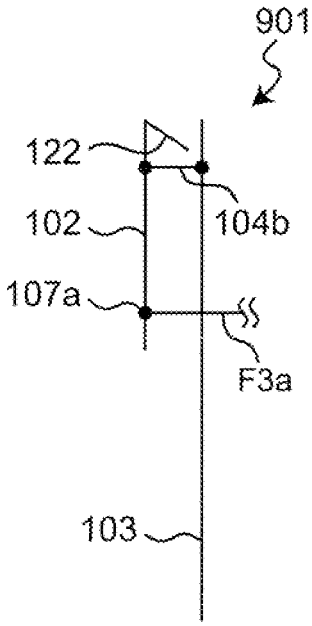
FIG. 18 is a side view showing an antenna apparatus 901 according to a fourth modified embodiment of the second embodiment of the present invention.

FIGS. 15 to 18 are side views showing antenna apparatuses 601, 701, 801, and 901 according to first to fourth modified embodiments of the second embodiment of the present invention. The extension conductor 122 is preferably bent in a direction from the antenna element 102 to the ground conductor 103 in order not to increase the dimensions of the antenna apparatus. The direction of bending is not limited to a direction perpendicular to the antenna element 102 as shown in FIG. 10*b*, and may be a direction shown in FIG. 15. In addition, the connecting points of the connecting conductors 104*a* and 104*b* on the antenna element 102 do not need to be close to the section of the antenna element 102 to which the extension conductor 122 is connected, as shown in FIGS. 9 and 15. The connecting points and the section may be arranged, for example, as shown in FIGS. 16 to 18, as long as the short-circuited end of the slit 105 is located farther away from feed points 106*a* and 107*a* than the connecting conductors 104*a* and 104*b*.

As described above, the antenna apparatus of the second embodiment is provided with the extension conductor 122 connected to the antenna element 102, and the slit 105 extending from the antenna element 102 to the extension conductor 122 so as to intersect a portion between the connecting points of the respective connecting conductors 104*a* and 104*b* on the antenna element 102 and to intersect a portion between the feed points 106*a* and 107*a* on the antenna element 102, thus adjusting only the isolation frequency without changing the size of the antenna apparatus, and enhancing flexibility in the design of a MIMO antenna apparatus, while having a simple configuration. Particularly, the antenna apparatus of the present embodiment advantageously decrease only the isolation frequency. Thus, it is possible to advantageously achieve good MIMO wireless communication even at low frequencies, while keeping the size of a MIMO antenna apparatus small.

Third Embodiment

Figure 19:
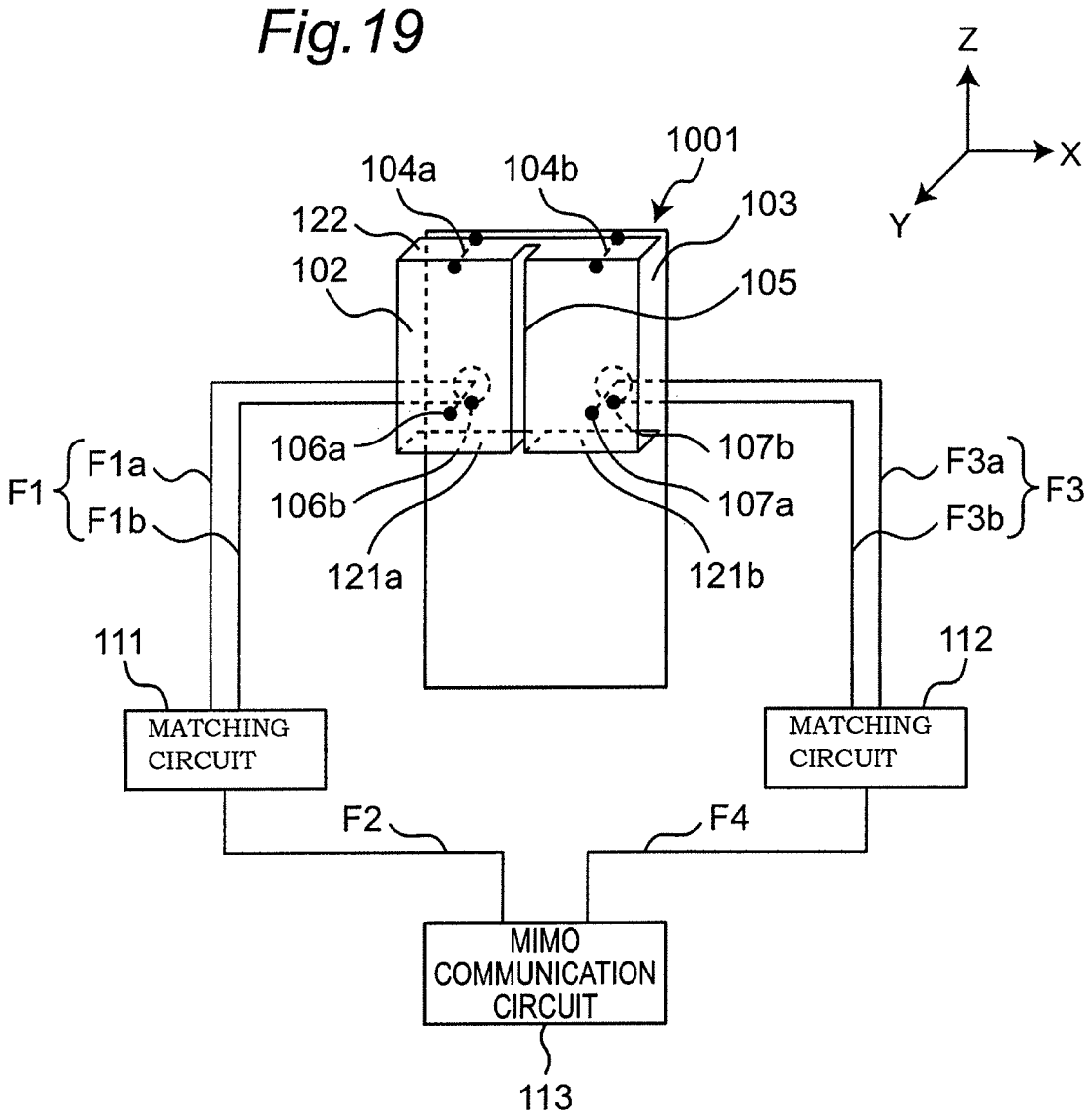
FIG. 19 is a block diagram showing schematic configurations of an antenna apparatus 1001 and a wireless communication apparatus using the antenna apparatus 1001, according to a third embodiment of the present invention.

FIG. 19 is a block diagram showing schematic configurations of an antenna apparatus 1001 and a wireless communication apparatus using the antenna apparatus 1001, according to a third embodiment of the present invention. The antenna apparatus 1001 of the present embodiment is characterized by having a combined configuration of the antenna apparatuses of the first and second embodiments.

Referring to FIG. 19, the antenna apparatus 1001 includes an antenna element 102, a ground conductor 103, and feed points 106*a* and 107*a* which are the same as those of the first and second embodiments. An extension conductor 121 (i.e., extension conductors 121*a* and 121*b*) is mechanically and electrically connected to a section of an outer perimeter of the antenna element 102 (a lower side in FIG. 19) and along the entire length of the section. An extension conductor 122 is mechanically and electrically connected to a different section of the outer perimeter of the antenna element 102 (an upper side in FIG. 19) and along the entire length of the section. Further, there are provided linear connecting conductors 104*a* and 104*b* which mechanically and electrically connect the antenna element 102 to the ground conductor 103, at connecting points on the antenna element 102 between the extension conductor 122 and the feed points 106*a* and 107*a*. A slit 105 extending 121 from the extension conductor 122 through the antenna element 102 to the extension conductor is provided so as to intersect a portion between the connecting points of the respective connecting conductors 104*a* on the antenna element 102 and 104*b* and to intersect a portion between the feed points 106*a* and 107*a* on the antenna element 102. The slit 105 has a short-circuited end on the extension conductor 122 and has an open end on the extension conductor 121. According to the antenna apparatus 1001 of the present embodiment, since the extension conductors 121 and 122 are connected to the antenna element 102, the slit 105 is extended to both the side of its open end and the side of its short-circuited end.

Since the extension conductor 121 is connected to the antenna element 102 at the section closer to the feed points 106*a* and 107*a* than the connecting conductors 104*a* and 104*b* in a manner similar to that of the first embodiment, the operating frequency of the antenna apparatus 1001 can be decreased. Thus, it is possible to advantageously reduce antenna size when designing an antenna apparatus with the same operating frequency. Further, since the extension conductor 122 is connected to the antenna element 102 on the section closer to the connecting conductors 104*a* and 104*b* than the feed points 106*a* and 107*a* in a manner similar to that of the second embodiment, the isolation frequency can be advantageously adjusted by the length "b" of an extended portion of the slit 105 on the extension conductor 122. Therefore, according to the antenna apparatus 1001 of the third embodiment, it is possible to advantageously solve both the problem of reduction of antenna size which is difficult to achieve at a low operating frequency, and the problem of decrease of isolation caused by a closer distance between the feed points with respect to the wavelength.

As described above, according to the antenna apparatus of the third embodiment, it is possible to operate the single antenna element 102 as two antenna portions, and achieve isolation between the feed points at a low isolation frequency, while having a simple configuration, thus reducing the size of a MIMO antenna apparatus necessary for mobile terminals.

Fourth Embodiment

FIGS. 20 to 23 are block diagrams showing schematic configurations of antenna apparatuses 1101, 1201, 1301, and 1401 and wireless communication apparatuses using the antenna apparatuses 1101, 1201, 1301, and 1401, according to a fourth embodiment of the present invention. An antenna apparatus according to an embodiment of the present invention may be configured using a slot, instead of the slit such as those in the first to third embodiments. The term "slot" means a slot having a two short-circuited ends, as shown for example in FIG. 20.

Figure 20:
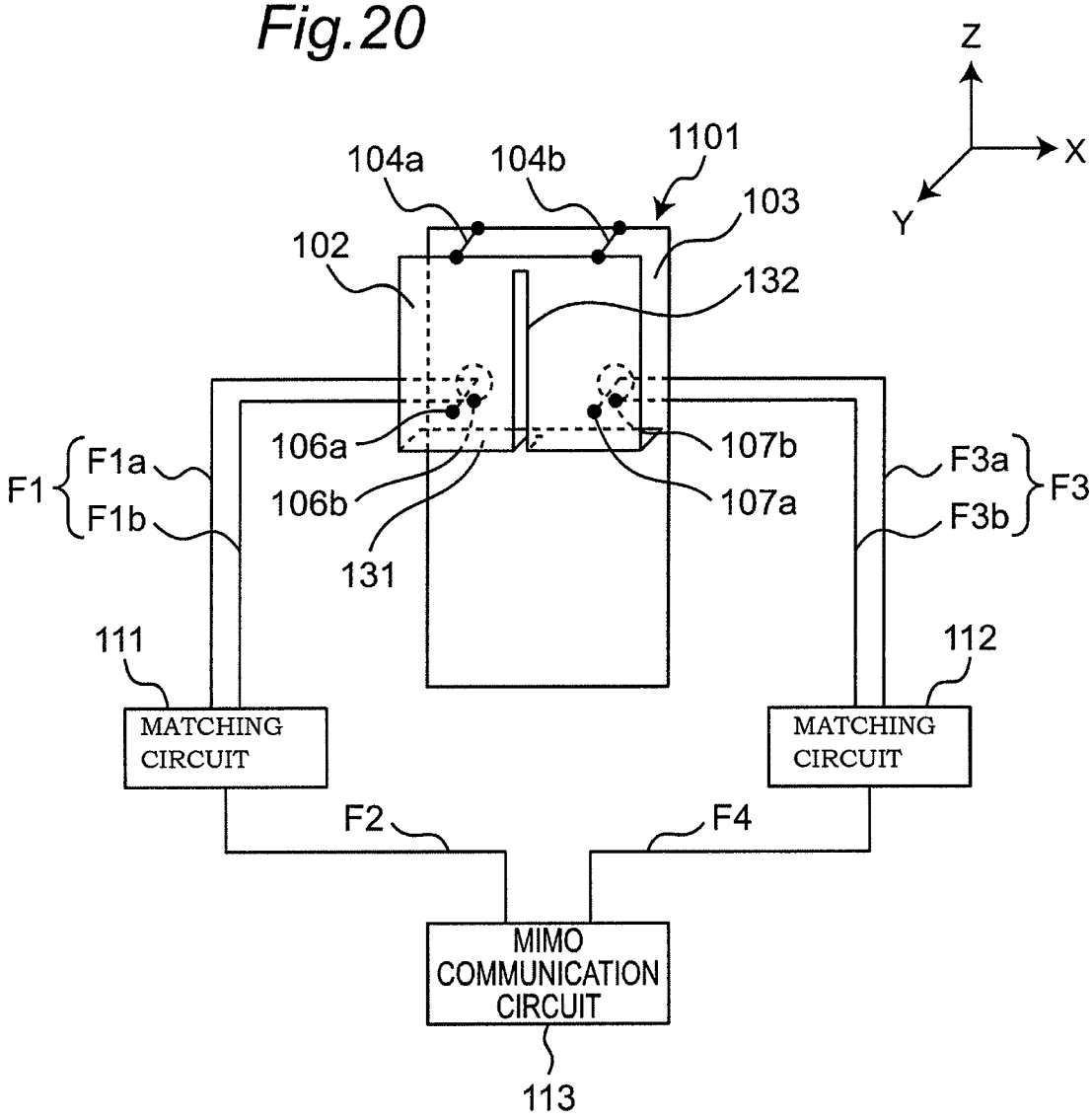
FIG. 20 is a block diagram showing schematic configurations of an antenna apparatus 1101 and a wireless communication apparatus using the antenna apparatus 1101, according to a fourth embodiment of the present invention.
Figure 21:
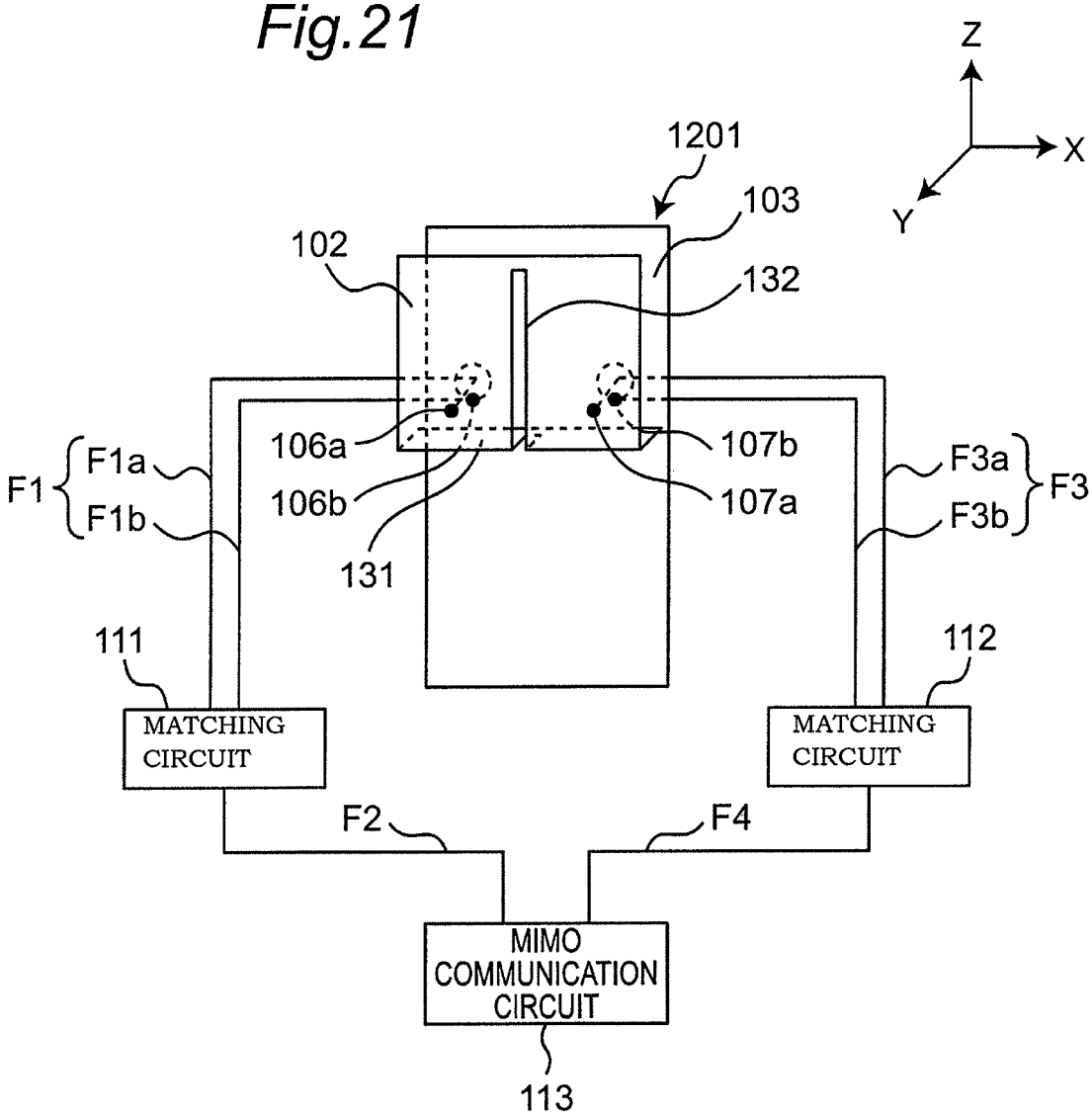
FIG. 21 is a block diagram showing schematic configurations of an antenna apparatus 1201 and a wireless communication apparatus using the antenna apparatus 1201, according to a first modified embodiment of the fourth embodiment of the present invention.
Figure 22:
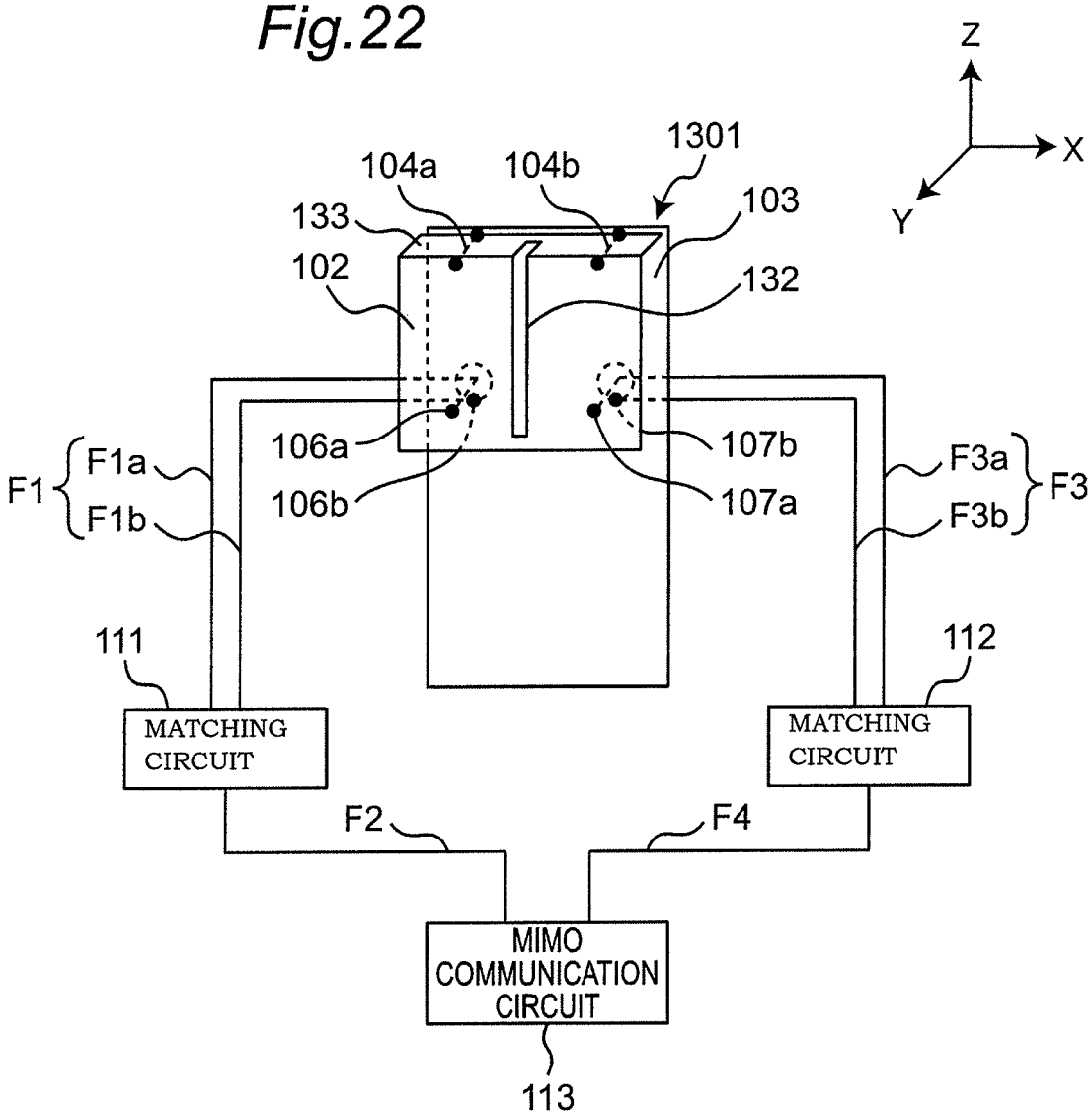
FIG. 22 is a block diagram showing schematic configurations of an antenna apparatus 1301 and a wireless communication apparatus using the antenna apparatus 1301, according to a second modified embodiment of the fourth embodiment of the present invention.
Figure 23:
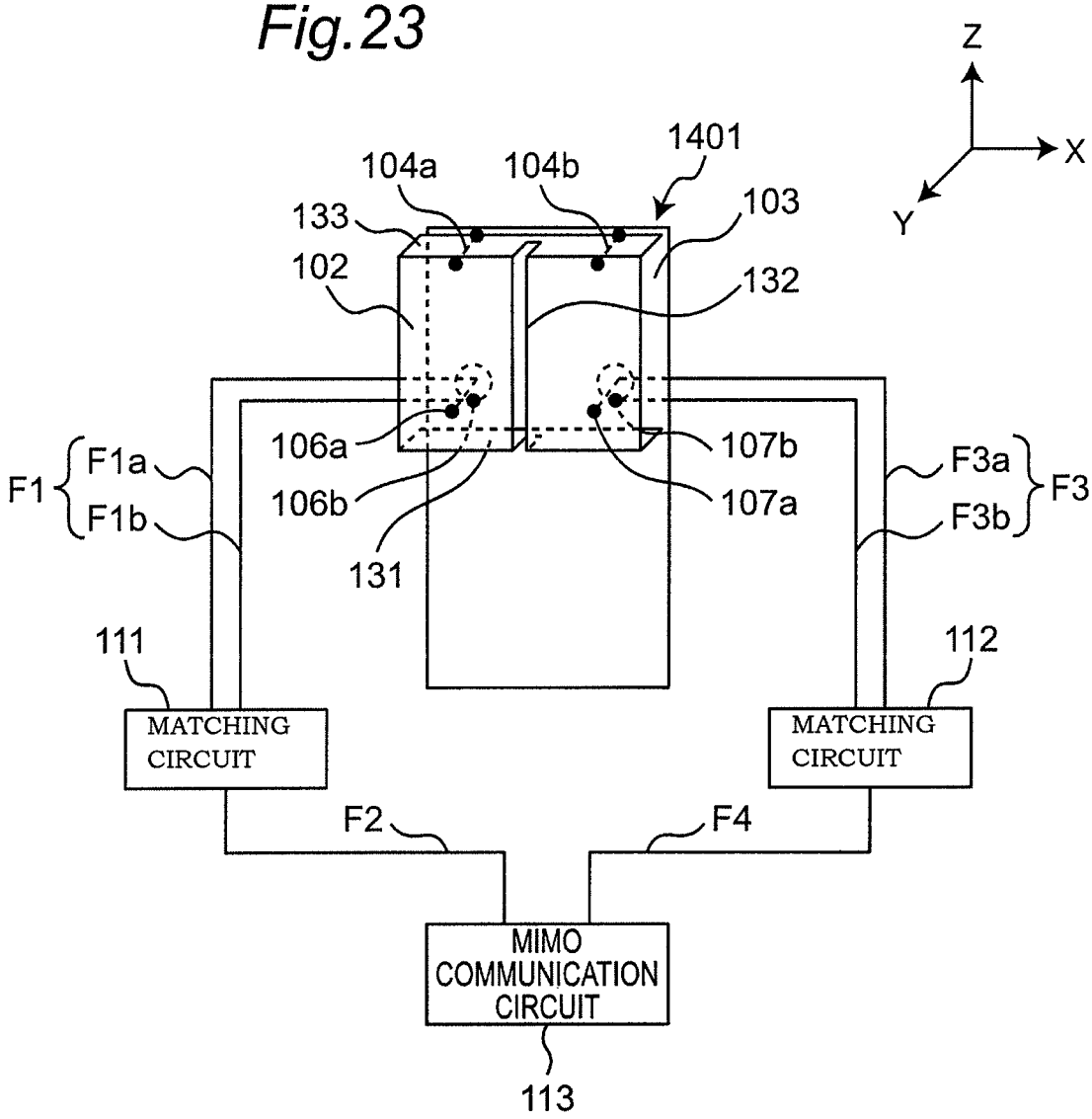
FIG. 23 is a block diagram showing schematic configurations of an antenna apparatus 1401 and a wireless communication apparatus using the antenna apparatus 1401, according to a third modified embodiment of the fourth embodiment of the present invention.

An antenna apparatus of FIG. 20 is provided with a slot 132 instead of the slit 105 of FIG. 1, and is provided with an extension conductor 131 instead of the extension conductor 121 of FIG. 1. The extension conductor 131 has a short-circuited end of the slot 132 instead of the open end of the slit 105. An antenna apparatus of FIG. 21 is provided with a slot 132 instead of the slit 105 of FIG. 8, and is provided with an extension conductor 131 instead of the extension conductor 121 of FIG. 8. An antenna apparatus of FIG. 22 is provided with a slot 132 instead of the slit 105 of FIG. 9, and is provided with an extension conductor 133 instead of the extension conductor 122 of FIG. 9. An antenna element 102 has a short-circuited end of the slot 132 instead of the open end of the slit 105. An antenna apparatus of FIG. 23 is provided with a slot 132 instead of the slit 105 of FIG. 19, is provided with an extension conductor 131 instead of the extension conductor 121 of FIG. 19, and is provided with an extension conductor 133 instead of an extension conductor 122 of FIG. 19. The extension conductor 131 has a short-circuited end of the slot 132 instead of the open end of the slit 105.

Also according to the antenna apparatuses 1101, 1201, 1301, and 1401 of FIGS. 20 to 23, it is possible to achieve desirable effects such as decrease of isolation frequency and reduction of antenna size in a manner similar to those of the first to third embodiments.

Antenna apparatuses and wireless communication apparatuses using the antenna apparatuses of the present invention can be implemented as, for example, mobile phones, or can also be implemented as apparatuses for wireless LANs. The antenna apparatuses can be mounted on, for example, wireless communication apparatuses performing MIMO communication. In addition to apparatuses for MIMO communication, the antenna apparatuses can also be mounted on array antenna apparatuses which use a plurality of antennas simultaneously, such as maximum ratio combining diversity, equiphase combining diversity, and adaptive array, and mounted on wireless communication apparatuses using any of those array antenna apparatuses.

REFERENCE SIGNS LIST

101, 201, 301, 401, 501, 601, 701, 801, 901, 1001, 1101, 1201, 1301, and 1401: ANTENNA APPARATUS,
102: ANTENNA ELEMENT,
103: GROUND CONDUCTOR,
104*a* and 104*b*: CONNECTING CONDUCTOR,
105: SLIT,
106*a* and 107*a*: FEED POINT,
106*b* and 107*b*: CONNECTING POINT,
111 and 112: IMPEDANCE MATCHING CIRCUIT,
113: MIMO COMMUNICATION CIRCUIT,
121*a*, 121*b*, 122, 131, and 133: EXTENSION CONDUCTOR,
132: SLOT,
F1, F2, F3, and F4: FEED LINE,
F1*a*, F1*b*, F3*a*, and F3*b*: SIGNAL LINE.

The invention claimed is:

1. An antenna apparatus comprising:

a planar antenna element provided on a ground conductor; and first and second feed points provided at positions on the antenna element, respectively, wherein the antenna element is simultaneously driven through the first and second feed points so as to simultaneously operate as first and second antenna portions associated with the first and second feed points, respectively, wherein the antenna apparatus further comprises:

a first extension conductor connected to a first section of an outer perimeter of the antenna element and along an entire length of the first section;

first and second connecting conductors respectively connecting the antenna element to the ground conductor at first and second connecting points on the antenna element between the first extension conductor and the first and second feed points;

a slit extending from the first extension conductor to the antenna element so as to intersect a portion between the first and second connecting points on the antenna element and to intersect a portion between the first and second feed points on the antenna element, the slit having a short-circuited end on the first extension conductor; and a second extension conductor connected to a second section of the outer perimeter of the antenna element and along an entire length of the second section, the second section being different from the first section, and wherein the slit extends from the first extension conductor through the antenna element to the second extension conductor so as to intersect the portion between the first and second connecting points on the antenna element and to intersect the portion between the first and second feed points on the antenna element, and the slit has the short-circuited end on the first extension conductor and has an open end on the second extension conductor.

2. An antenna apparatus comprising:

a planar antenna element provided on a ground conductor; and first and second feed points provided at positions on the antenna element, respectively, wherein the antenna element is simultaneously driven through the first and second feed points so as to simultaneously operate as first and second antenna portions associated with the first and second feed points, respectively, wherein the antenna apparatus further comprises:

a first extension conductor connected to a first section of an outer perimeter of the antenna element and along an entire length of the first section;

first and second connecting conductors respectively connecting the antenna element to the ground conductor at first and second connecting points on the antenna element between the first extension conductor and the first and second feed points; and a slot extending from the first extension conductor to the antenna element so as to intersect a portion between the first and second connecting points on the antenna element and to intersect a portion between the first and second feed points on the antenna element, the slot having a first short-circuited end on the first extension conductor; and a second extension conductor connected to a second section of the outer perimeter of the antenna element and along an entire length of the second section, the second section being different from the first section, and wherein the slot extends from the first extension conductor through the antenna element to the second extension conductor so as to intersect the portion between the first and second connecting points on the antenna element and to intersect the portion between the first and second feed points on the antenna element, and the slot has the first short-circuited end on the first extension conductor and has a second short-circuited end on the second extension conductor.

3. A wireless communication apparatus transmitting or receiving a plurality of radio signals, the apparatus comprising:

an antenna apparatus comprising: a planar antenna element provided on a ground conductor; and first and second feed points provided at positions on the antenna element, respectively, wherein the antenna element is simultaneously driven through the first and second feed points so as to simultaneously operate as first and second antenna portions associated with the first and second feed points, respectively, wherein the antenna apparatus further comprises:

a first extension conductor connected to a first section of an outer perimeter of the antenna element and along an entire length of the first section;

first and second connecting conductors respectively connecting the antenna element to the ground conductor at first and second connecting points on the antenna element between the first extension conductor and the first and second feed points; and a slit extending from the first extension conductor to the antenna element so as to intersect a portion between the first and second connecting points on the antenna element and to intersect a portion between the first and second feed points on the antenna element, the slit having a short-circuited end on the first extension conductor; and a second extension conductor connected to a second section of the outer perimeter of the antenna element and along an entire length of the second section, the second section being different from the first section, and wherein the slit extends from the first extension conductor through the antenna element to the second extension conductor so as to intersect the portion between the first and second connecting points on the antenna element and to intersect the portion between the first and second feed points on the antenna element, and the slit has the short-circuited end on the first extension conductor and has an open end on the second extension conductor.

* * * * *